US007418796B2

(12) United States Patent
Anastasio

(10) Patent No.: US 7,418,796 B2
(45) Date of Patent: Sep. 2, 2008

(54) METHOD AND APPARATUS FOR FRAMING PHOTOS AND PICTURES

(76) Inventor: Annmarie Anastasio, 307 Bay Dr., Massapequa, NY (US) 11758

( * ) Notice: Subject to any disclaimer, the term of this patent is extended or adjusted under 35 U.S.C. 154(b) by 525 days.

(21) Appl. No.: 10/993,855

(22) Filed: Nov. 19, 2004

(65) Prior Publication Data

US 2005/0102878 A1 May 19, 2005

Related U.S. Application Data

(60) Provisional application No. 60/527,940, filed on Dec. 8, 2003, provisional application No. 60/523,222, filed on Nov. 19, 2003.

(51) Int. Cl.
*A47G 1/06* (2006.01)

(52) U.S. Cl. ..... 40/735; 40/737; 40/772; 40/773

(58) Field of Classification Search ..... 40/737, 40/735, 594, 661, 798, 772, 773
See application file for complete search history.

(56) References Cited

U.S. PATENT DOCUMENTS

| | | | | | |
|---|---|---|---|---|---|
| 1,802,170 | A | * | 4/1931 | Colbert et al. | 40/737 |
| 2,499,731 | A | * | 3/1950 | Derington | 40/541 |
| 4,270,291 | A | * | 6/1981 | Babberl | 40/594 |
| 4,916,584 | A | * | 4/1990 | Gustafson | 362/503 |
| 4,955,153 | A | * | 9/1990 | Albrecht et al. | 40/661 |
| 5,096,752 | A | * | 3/1992 | Wagner | 428/13 |
| 5,253,439 | A | | 10/1993 | Shanok et al. | |
| 5,375,352 | A | * | 12/1994 | Morris | 40/737 |
| 6,052,933 | A | * | 4/2000 | Lytle | 40/711 |
| 6,151,822 | A | * | 11/2000 | Kenney | 40/661 |
| 6,219,950 | B1 | | 4/2001 | Hsu | |
| D441,547 | S | | 5/2001 | Hayashi | |
| D448,308 | S | | 9/2001 | Weinstein | |
| 6,282,828 | B1 | | 9/2001 | Cecchetto | |
| 6,324,778 | B1 | * | 12/2001 | Gall | 40/594 |
| D455,565 | S | | 4/2002 | Pozzoli et al. | |
| 6,378,233 | B1 | | 4/2002 | Haines-Woon | |
| 6,385,883 | B1 | * | 5/2002 | Votolato | 40/594 |
| D462,840 | S | | 9/2002 | Chan | |
| D473,145 | S | | 4/2003 | Chang | |
| 6,574,896 | B1 | * | 6/2003 | Howell | 40/737 |
| 7,146,759 | B2 | * | 12/2006 | Bell | 40/734 |
| 2001/0027617 | A1 | * | 10/2001 | McGuiness | 40/124.11 |
| 2006/0185210 | A1 | * | 8/2006 | Beigel | 40/711 |
| 2007/0033848 | A1 | * | 2/2007 | Rosenbaum et al. | 40/735 |

FOREIGN PATENT DOCUMENTS

JP 2003020826 * 1/2003

* cited by examiner

*Primary Examiner*—William L. Miller
(74) *Attorney, Agent, or Firm*—Hiscock & Barclay, LLP

(57) ABSTRACT

The invention comprises, in one form thereof, a customized picture framing apparatus and method of making the same. The framing apparatus includes a window, a picture affixed to the window, and a custom cut piece of glass attached to the window through the application of an adhesive material to at least one of the sides of the custom cut piece of glass. Decorations such as paint, a decorative pattern, and three-dimensional items may be added to the framing apparatus.

20 Claims, 7 Drawing Sheets

METHOD AND APPARATUS FOR FRAMING PHOTOS AND PICTURES

CROSS-REFERENCE TO RELATED APPLICATIONS

This application claims priority from Provisional Patent Application Ser. No. 60/523,222, filed Nov. 19, 2003 and Provisional Patent Application Ser. No. 60/527,940, filed Dec. 8, 2003.

FIELD OF THE INVENTION

This invention relates generally to a method and apparatus for framing photos and pictures.

BACKGROUND OF THE INVENTION

Photo and picture frames are well known. Various embodiments of known photo and picture frames include an ornamental design for a clock with photo frame (U.S. Pat. No. D473,145), various ornamental designs for photo frames (e.g., U.S. Pat. Nos. D462,840, D455,565, D441,547, D448,308), a photo postcard display (U.S. Pat. No. 6,378,233), a photo frame pen (U.S. Pat. No. 6,282,828), a photo frame with build in mini-fan (U.S. Pat. No. 6,219,950), and a picture frame and method of forming same (U.S. Pat. No. 5,253,439), to name a few.

A photo or picture frame is commonly used as a means for displaying one or more photographs and/or pictures. Many individuals place a photo and/or picture frame in a place of prominence, which ensures easy and routine viewing of favorite photographs and/or pictures. Typically, such a photo or picture frame is of a particular geometric shape (e.g., square, rectangular, circular, etc.) and has an opening on what would be considered the back or rear, with said opening being particularly adapted for receiving photographs and/or pictures. Perhaps the most common type of such photo or picture frames also includes a collapsible stand for supporting the frame, and/or certain and various means for hanging the frame.

Generally speaking, available photo and picture frames are quite similar, owing any marginal differences to the shape and size of the frame itself. Perhaps the single most important reason that available photo and picture frames are so uniform in their appearance, design and manufacture is because it is desired by many that such frames allow for photographs and pictures to be easily removed and replaced. This remove and replace functionality is prized by some because of the inevitable former friend, significant other, or spouse whose photo is no longer wished to be displayed. Yet, the desire for such replace and remove functionality has lead to an industry where virtually all photo and picture frames are similar in their design, function, manufacture and appearance. The fact that available photo and picture frames are virtually identical in design, function, manufacture and appearance has severely limited framing options and available choices for those interested in a creative, non-traditional and/or permanent way to display photographs and pictures.

Moreover, traditionally when someone has a photograph or picture that they want to frame they have to go out and find a frame to match the photo or picture. Matching original photographs, for example, with pre-existing, largely uniform frames can be particularly difficult and certainly limits artistic, aesthetic, functional and personal choices.

Accordingly, there is presently a need for a picture frame or photo frame that allows for creative, non-traditional and/or permanent ways to display photographs and pictures. Furthermore, there is presently a need for a picture frame or photo frame that matches, compliments and/or enhances the photo (s) or picture(s) selected for display. Still further, there is presently a need for a picture frame or photo frame that can be created and/or customized to match, compliment and/or enhance the photograph or picture.

None of the abovementioned inventions and patents, taken either singly or in combination, is believed to describe in part or in whole the present invention.

SUMMARY OF THE INVENTION

The present invention advantageously fills the aforementioned deficiencies in the prior art by providing a method and apparatus for framing one or more photographs and/or pictures. Particularly, the present invention is drawn to a picture or photo frame that allows for the creative, non-traditional, and/or permanent display of photographs, pictures or a combination of photographs and pictures.

The present invention also advantageously enables for the recycling of old window frames, particularly wood-paned window frames that are so commonly being replaced by newer, more efficient windows. The present invention, while not limited to using old window frames, does allow for such windows to be recycled and used for the purpose of framing and ultimately displaying photographs or pictures in a creative, non-traditional and unique way.

The present invention also advantageously enables the creation of a photo or picture anthology.

The present invention also advantageously allows for the customization and personalization of a photo or picture frame based on particular preferences, choices and/or artistic inclinations and leanings.

It is an object of the present invention to provide a beautiful three-dimensional artistic photographic anthology.

It is another object of the present invention to provide a display means of novel configuration made from a new or used picture window.

It is another object of the invention is to provide a display means that is low cost and economical to manufacture.

It is an object of the invention to provide improved elements and arrangements thereof in a display means for inexpensively, dependably and effectively accomplishing the original and unique display of photographs and/or pictures.

It is another object of the present invention, at least in one particular embodiment, to provide a use of old picture windows, which will allow for the recycling of said picture windows.

It is a further object of the invention to provide a picture frame or photo frame that can be created and/or customized to match, compliment and/or enhance the photograph(s) or picture(s).

Other aspects of the present invention are directed to a method of making, which corresponds to the previously described apparatus.

Those skilled in the art will appreciate still further uses and objects of the present invention, with said uses and objects being understood to be included and covered by the present invention after reference to the entire specification and claims.

BRIEF DESCRIPTION OF THE DRAWINGS

The above-mentioned and other features and advantages of this invention, and the manner of attaining them, will become apparent and be better understood by reference to the following description of several embodiments of the invention in conjunction with the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION

Figure 1:
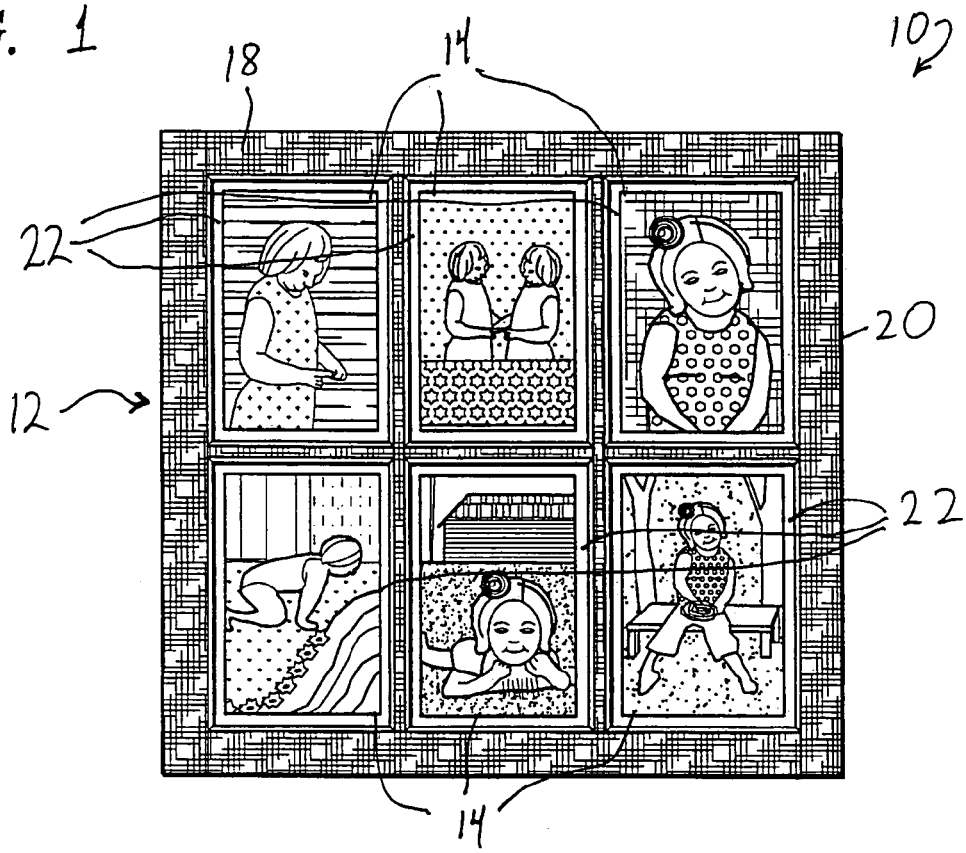
FIG. 1 is a front view of a photo/picture framing apparatus without three dimensional effects.
Figure 2:
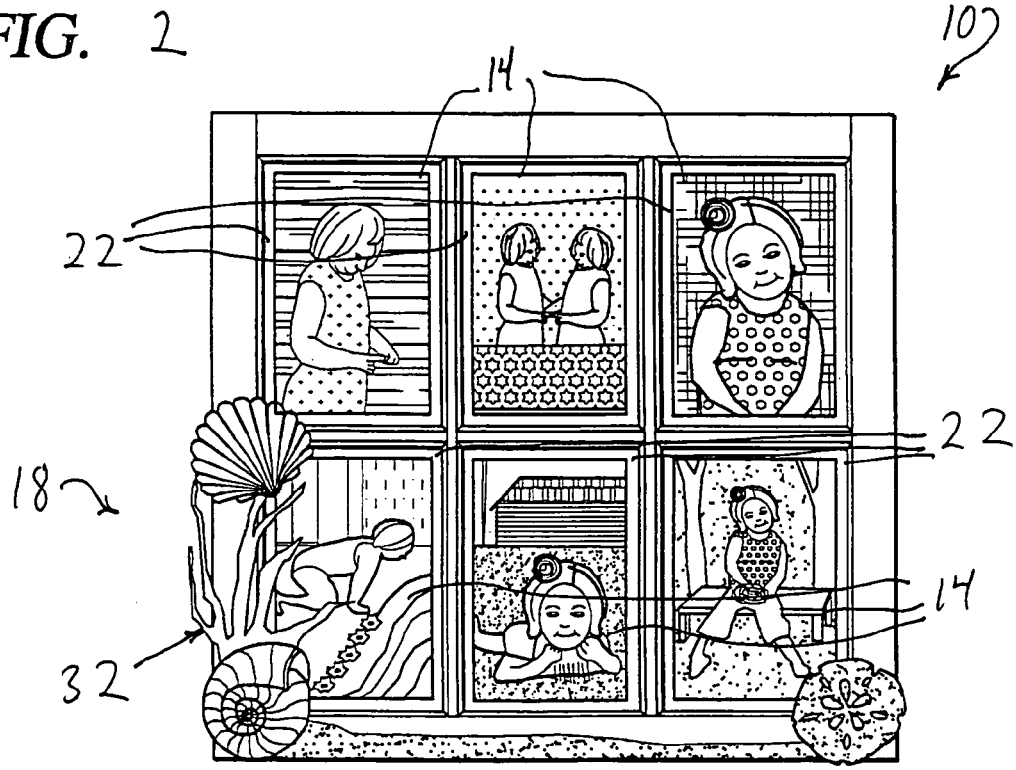
FIG. 2 is a front view of a finished photo/picture framing apparatus together with three dimensional effects.

The present invention is directed to a method and apparatus for framing pictures, which, for the purpose of this disclosure will be considered to include photographs, paintings, drawings, and other substantially flat items. Referring to FIGS. 1 and 2, there is shown the picture frame of the present invention. The picture frame 10 includes a window 12, one or more pictures 14, a backing 16, and a decoration 18.

The window 12 includes a window frame 20 and one or more windowpanes 22. The windowpanes 22 are affixed to the window frame 20 by an adhesive or other suitable method. The pictures 14 are adhered to the windowpanes 22 or the frame 20. An additional windowpane 22 may be placed over a picture 14 to retain the picture 14.

Figure 3:
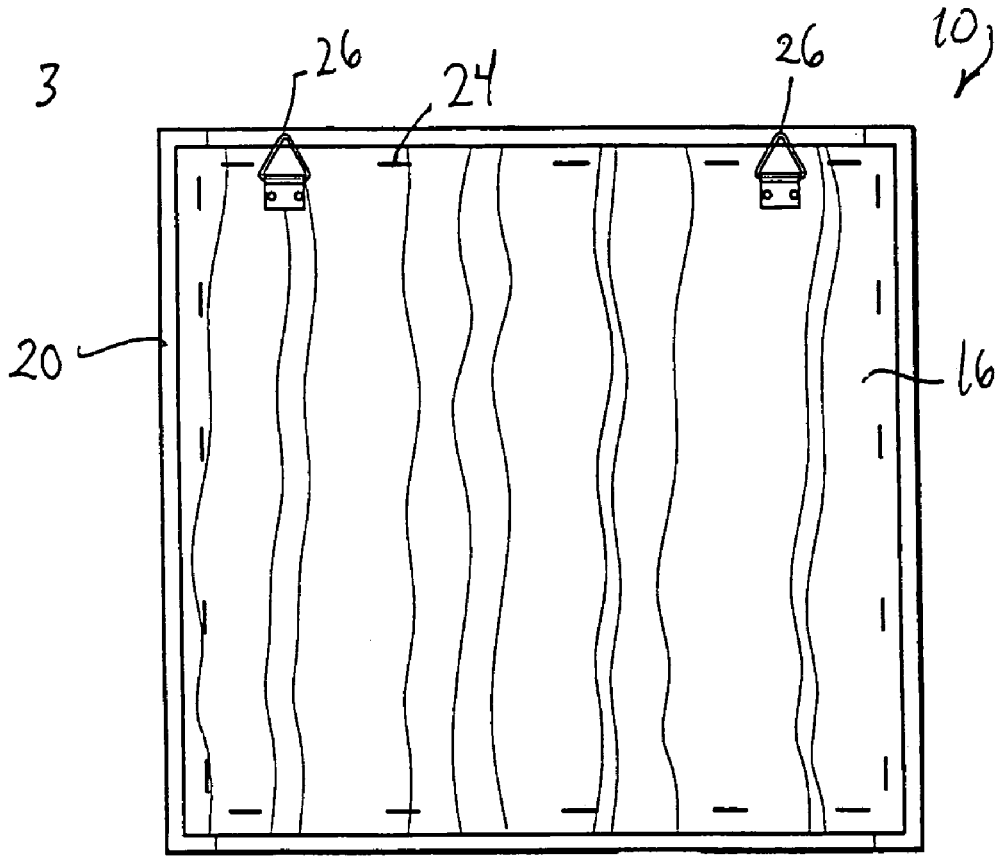
FIG. 3 is back view of a photo/picture framing apparatus.

The backing 16 is shown in FIG. 3 and is affixed to the back of the frame using fasteners 24 such as staples or nails or using an adhesive. The backing 16 includes one or more hangers 26. The decoration 18 is in the form of a pattern applied to the picture frame 10 as shown in FIG. 1. The decoration 18 alternatively is in the form of a three-dimensional effects as shown in FIG. 2.

Figure 4:
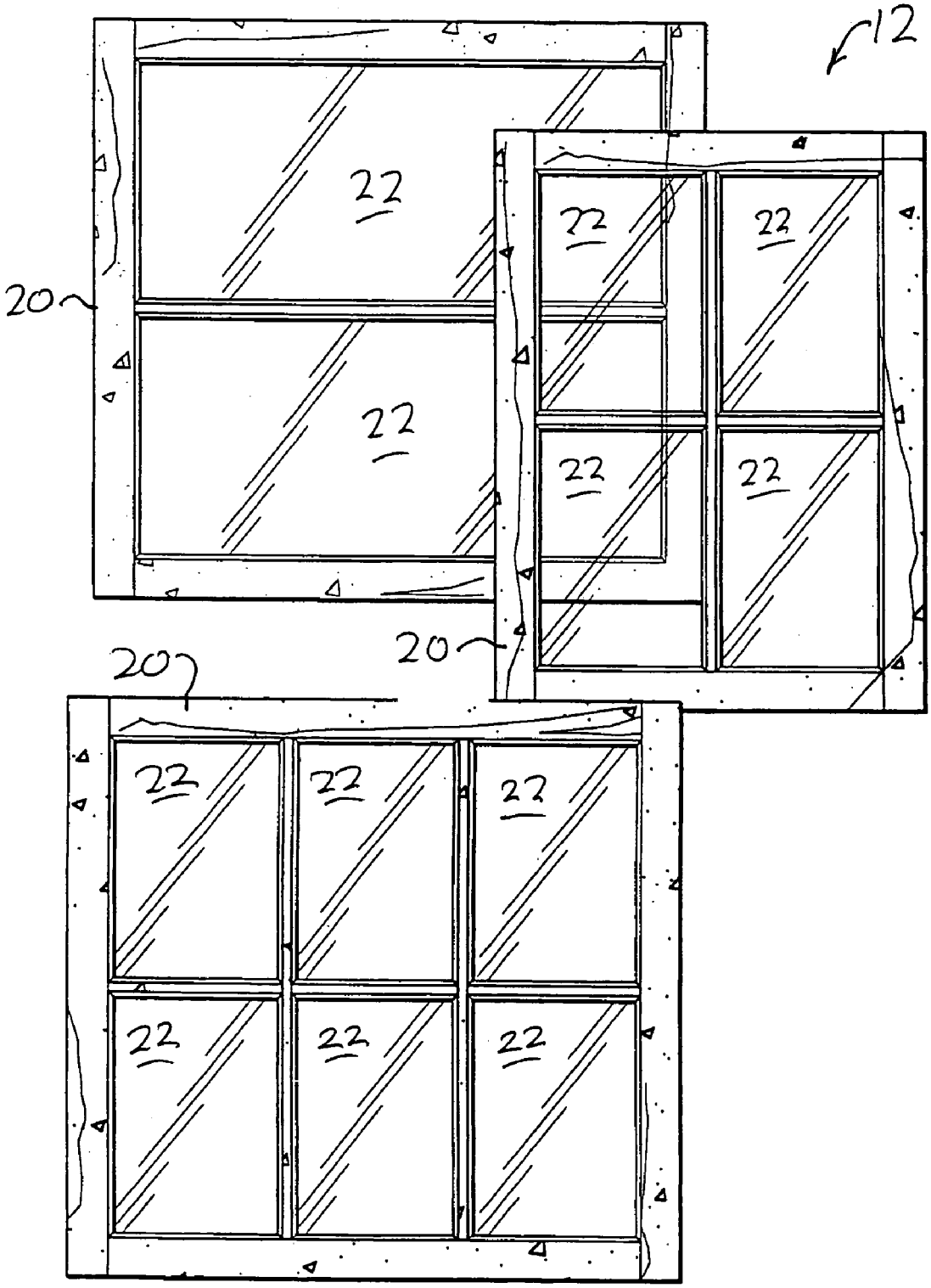
FIG. 4 shows several alternative window frames.

In use, it is necessary to obtain a window 12 such as those in FIG. 4 having multiple frames. While any window 12 will suffice, the present embodiment comprises a wood paned window having six frames. It should be understood, however, that windows made out of material other than wood will certainly suffice and are intended to be covered by the present invention and disclosure. Likewise, it should be understood that while the current embodiment of the present invention utilizes a window 12 having six frames, a window with fewer frames, as well as a window with more frames, will work for the intended purpose and are intended to be covered by the present invention and disclosure. Furthermore, it should be understood that while the current embodiment includes the acquisition of an old, removed or recycled window 12, a new or specially manufactured window can be used and is contemplated as being a part of the invention, at least in one particular embodiment of the invention.

Figure 5:
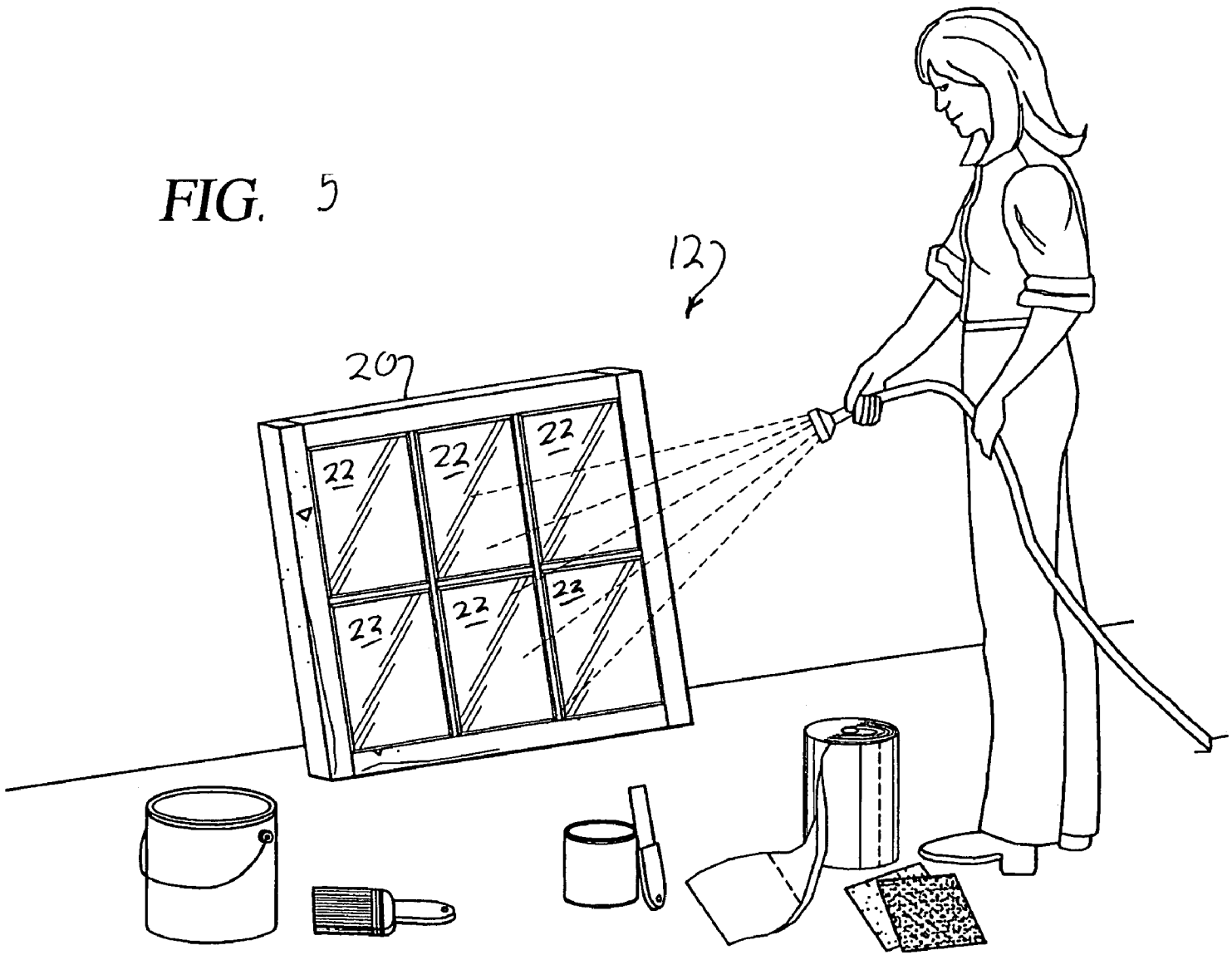
FIG. 5 demonstrates the removal of dirt and/or old chipped paint.

If necessary, the next step calls for the removal of dirt and/or old chipped paint as shown in FIG. 5. This can be accomplished, for example, with use of a high-powered hose and by spraying down the front, sides, and back of the window 12. If a hose is used it will be necessary to dry the entire window 12 before proceeding. Once any dirt is removed and the window 12 is dry, the window 12 is laid down, preferably on a flat surface, with the back of the window 12 facing up.

In one embodiment of the present invention, if the window frame 20 used is marked, grooved or otherwise worn, as will frequently be the case particularly when using old windows 12 that are being recycled, sand paper or other similar abrasive or electric sanding tool is used to smooth the window frame 20. If some form of sanding or smoothing is used, care should be taken to remove dust and foreign particles. This can be accomplished simply by wiping down the window frame 20.

At this point it is recommended that each of the windowpanes 22 be carefully observed to determine if they are adequately secured to the window frame 20. If the integrity of any windowpane 22 is in question, or if any corking or other adhesive has eroded, the window 12 is re-corked with silicone, glue, paste, putty or other similar agent. If such re-corking is performed, sufficient time for drying and setting should be allowed prior to moving forward. It has been found that approximately four hours is an appropriate time to wait, but this time can certainly vary, and sometimes greatly, depending upon the material used, weather and environmental conditions, and various other factors.

When preparing the window frame 20, it may be desired to apply a base coat of some kind of paint, including primer, a clear coat or any type of paint, to all parts of the front of the window frame 20.

Figure 6:
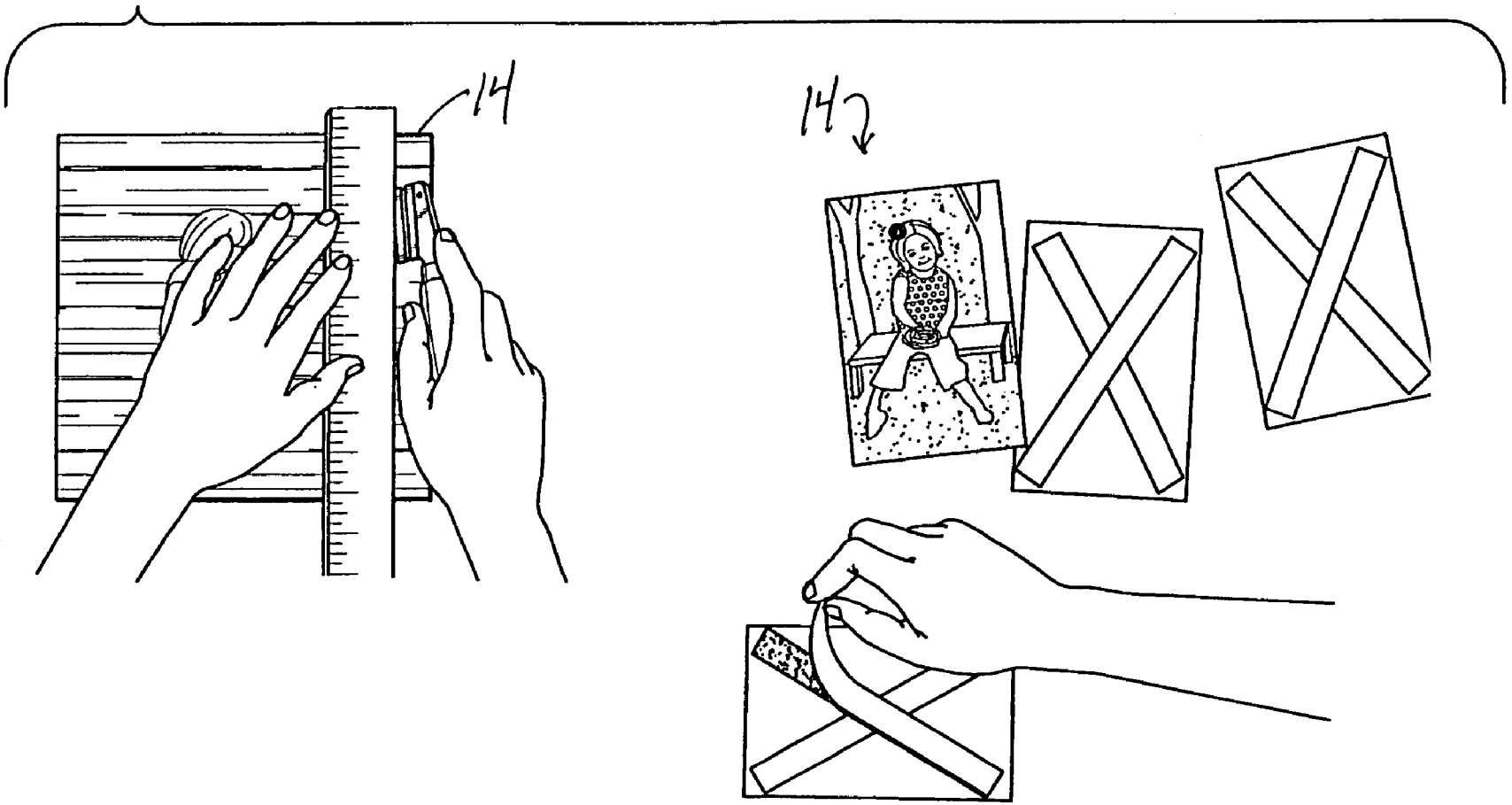
FIG. 6 shows the cropping of a photo/picture and a method for placing adhesive to the back of said photo/picture.

Next, as shown in FIG. 6, the pictures 14 are cropped so that they fit inside of the glass windowpanes 22. According to the present embodiment, the pictures 14 are cropped to a size that allows for approximately a one inch border on all four sides of the windowpane 22, though this is certainly not required. The pictures 14 are then arranged in the windowpanes 22 in any order, especially an order that is most appealing to the eye. It should, however, easily be seen that other manners of sequencing are certainly appropriate and covered by the present invention. It may be desirous to create a sequencing that acts as a time line, such that earlier pictures 14 appear first, followed by later pictures 14 in sequence. Still other alternatives, including the random selection of pictures 14 are certainly also covered by the present invention.

Next, using some type of means for attaching, such as tape, double-sided tape, glue, or other adhesive, the pictures 14 are affixed directly to the front of the window 12. In the current embodiment, double-sided tape is applied to the back of the pictures 14 in the form of an "X," although other configurations are certainly acceptable. Finally, if the pictures 14 have been cropped as suggested above (i.e., cropped to a size that allows for approximately a one inch border on all four sides of the windowpane 22), the picture 14 is affixed in the center of the windowpane 22 such that there is indeed an equal border on all four sides according to the current embodiment.

Figure 7:
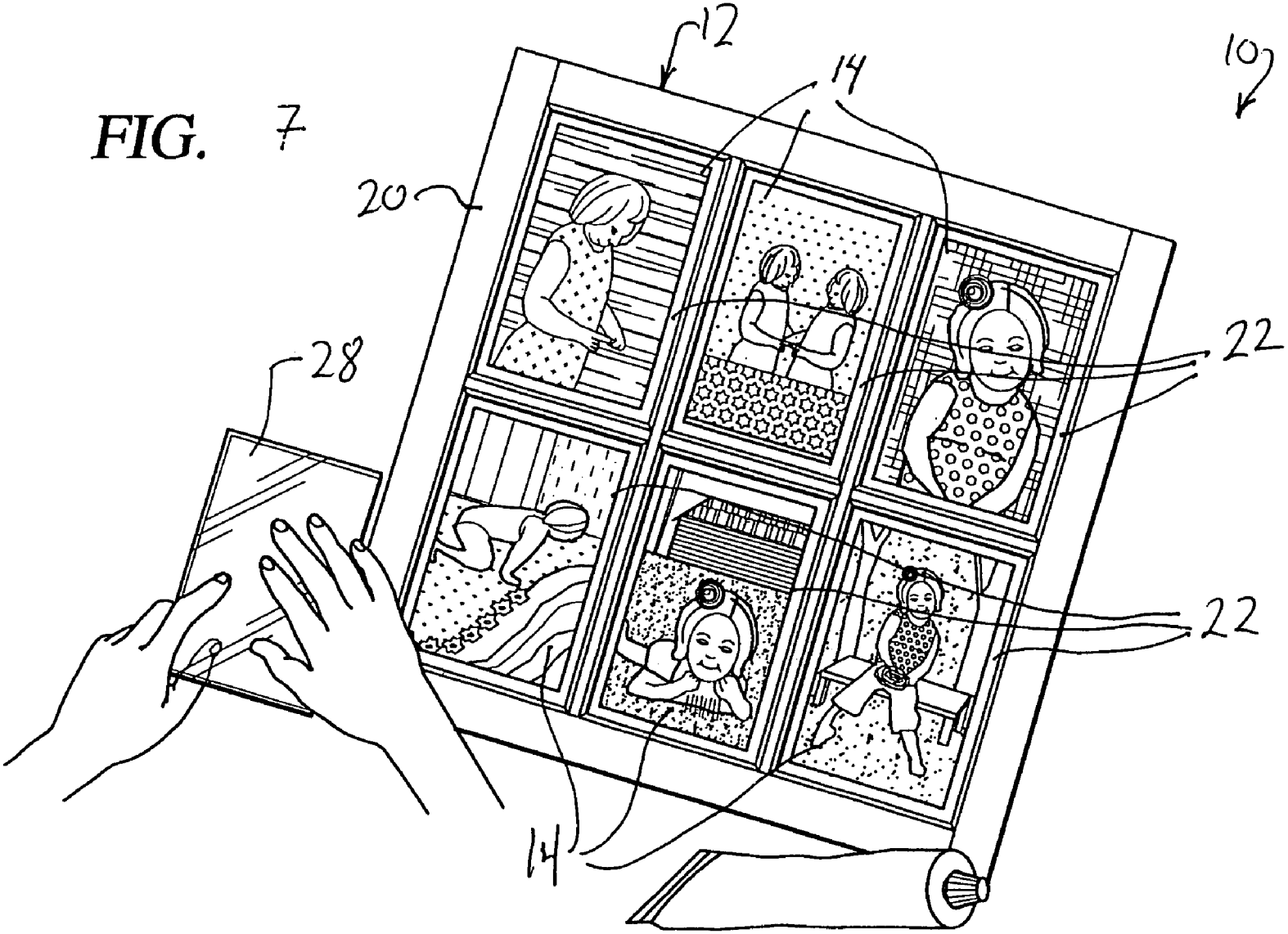
FIG. 7 is a front view of a photo/picture framing apparatus, showing a custom cut piece of glass and application thereof.
Figure 8:
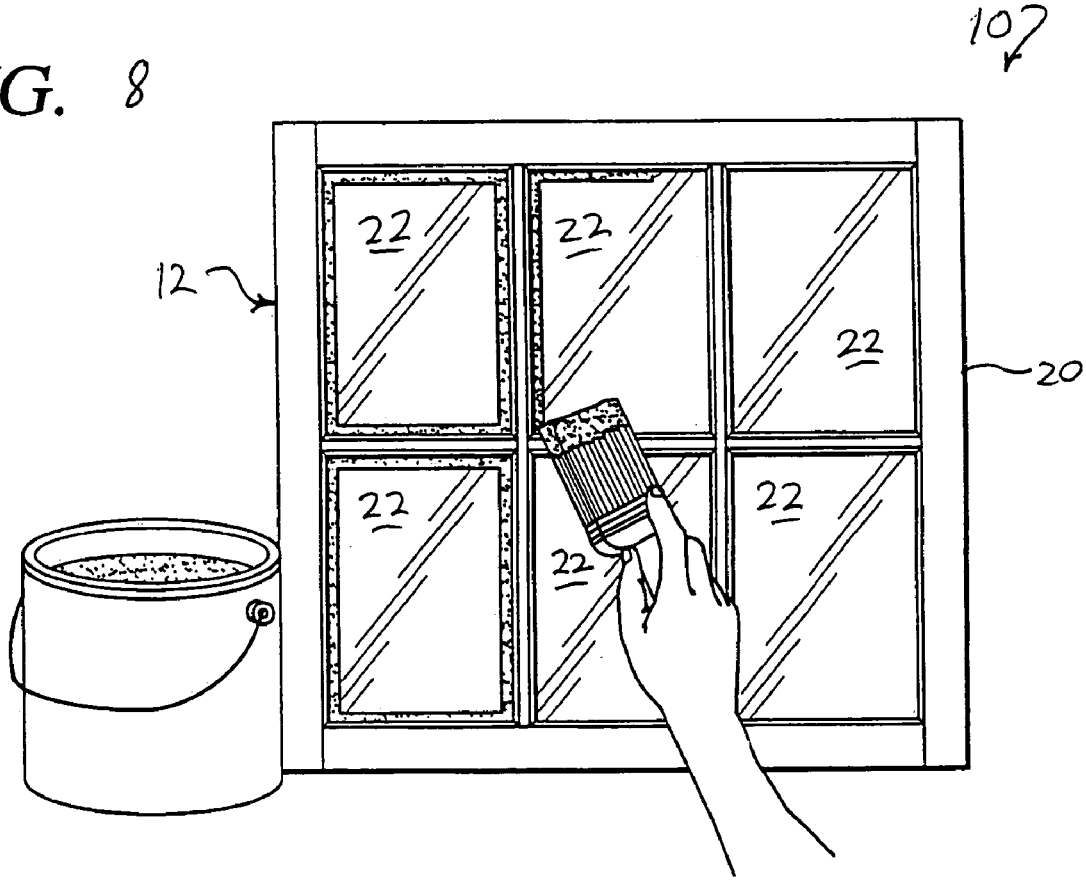
FIG. 8 is a front view of a photo/picture framing apparatus, showing the application of interior flat paint to the window frame.

After following the aforementioned steps the chosen pictures 14 are now arranged in an original, non-traditional, unique and creative way through the use of the window frame 20. Further and additional embodiments of the present invention are certainly possible. For example, once the pictures 14 are affixed to the window 12 one may choose to place a piece of custom cut glass 28 over top of the pictures 14, as shown in FIG. 7. The piece of the custom cut glass 28, which is cut to the same size as the pictures 14, or alternatively cut to any size capable of being laid over top of the picture 14 and not interfering with the windowpane 22, is now placed over the picture 14. This will result in the picture 14 being sandwiched between two pieces of glass, namely the glass 22 of the window 12 itself and the custom cut piece of glass 28. The custom cut glass 28 is now affixed to the windowpane 22. One method for affixing the custom cut glass 28 is to use a flexible clear silicone sealant to adhere the two pieces of glass together as shown in FIG. 8. Other methods of affixing, through the use of various adhesives, are certainly also appropriate. While only enough adhesive to accomplish affixing the custom cut glass 28 is necessary, in the current embodiment the adhesive is applied to all four sides of the glass 28, taking care not to allow the adhesive to cover or spill onto the picture 14 to thereby ensure a reliable connection.

In another embodiment of the present invention, once the pictures 14 are affixed to the window 12 one may choose not to use the custom cut piece of glass 28 described above. Instead, a box frame (also known in the craft industry as a shadow box frame, shadow frame or shadow box) may be used. In the embodiment of the invention employing a box frame, three-dimensional effects 32, including but not limited to silk flowers, dried flowers, feathers, ivy, fur, fake fur, rocks, glass stones, stones, shells, starfish, dry beans, dry pasta, candy canes, airless balloons, twigs, leaves, branches, acorns, rice, Styrofoam, crayons, pencils, cotton balls, fake snow, pine cones, glitter, tissue paper, felt, beads, lace, candy canes, hard candy, ornaments, garland, wire, raffia, twigs, wax, dog biscuits, holly, berries, dried fruit, rope, thread, fibers, yarn, paperclips, staples, pens, pencils, markers, brushes, natural excelsior, reindeer moss, sphagnum or sheet moss, Spanish moss, Hiawatha green moss, potpourri, glass marbles, sponges, hardwood accents, ribbon and the like can be applied to the ledges and walls that make up the sides of the box frame. Through the use of the box frame depth, accent and additional perspective can be added. More particularly, the box frame adds depth to the window frame 20 to thereby support the three-dimensional objects 32 that may be affixed to the box frame or loosely placed within the box frame. For example, as may be appropriate for photos taken at a beach, sand and tiny shells may be placed between the box frame and photo. The sand and shells are supported by the box frame and no additional adhesive is required so that the sand and shells may move around freely. Alternatively, adhesives and/or fasteners are used to retain the sand and shells. Those skilled in the art will appreciate that it is also possible to use the custom cut piece of glass 28 together with a box frame, but the current embodiment of the invention is to use one or the other, not both.

In another embodiment of the present invention interior flat paint, preferably a dark color such as green, is applied to the window frame 20. This paint is preferably applied prior to affixing any pictures 14, and is applied to a one inch border around all four sides of each glass window pane 22.

In another embodiment of the present invention, the backing 16, which can be a piece of dust cover paper, cardboard, wood, or other similar material, is cut to the size of the window 12 and then affixed to the back of the window 12. An electric staple gun is used to staple the backing 16 to the rear of the window 12, leaving approximately a four to six inch space between staples. Other fastening methods may be employed, however.

In another embodiment of the present invention, the picture hanger 26 is affixed to the back top of the window 12. The picture hanger 26 should be of an appropriate weight and strength to adequately support the window 12 when hung. For example, normally for a six-pane window a 50 lb hanger will usually suffice. The picture hanger 26 is hung low enough on the frame 20 so that it will not be exposed when hung. It may be desirous to use more than one picture hanger 26. It should be noted, however, that other hanging means are also capable of use and within the scope of the present invention. For example, one common method of hanging photos, pictures and paintings, which would certainly work for the present invention, is to nail or screw some form of hook or eye into opposite sides of the window frame and then secure a wire, rope or twine to each end of the hooks or eyes.

In another embodiment of the present invention, a product that gives the window frame 20 a weathered look, such as crackle, is applied over the entire surface of the window frame 20. In another embodiment of the present invention, a topcoat is applied over the window frame 20 using paint, preferably an interior flat paint in a color matching the decor of the room in which the window 12 will be displayed. This topcoat can be applied even over the crackle. Additionally, in another embodiment a water-based polyurethane is applied to the window frame 20 over the topcoat.

In still another embodiment of the present invention, a border is applied to the window frame 20. This border is preferably determined by the nature of the pictures 14 and/or personal preferences. This border can be any of a variety of materials, such as reindeer moss, Natural Excelsior Moss, Hiawatha Green Moss, artificial grass, potpourri, sand, shells, rope, ribbon, toile, marbles, bark, hay, leaves, fabric, foil, ame', denim, felt, suede, leather, wood, cardboard, buttons, metal, and other similar materials. It should readily be understood, however, that the types of material that can be used are virtually endless, and anything that is used for the border can also be used for the three dimensional effects 32 (described infra). Any means for affixing (including, nailing, screwing, taping, gluing and tacking) the border to the window frame 20 will suffice. For example, a hot glue gun is used to apply glue in three to four inch stretches to the bordered glass area surrounding the pictures 14. While the glue is still hot, apply the border. Various densities of border application are envisioned to be covered by the present invention.

In still another embodiment of the present invention, three-dimensional effects 32, including but not limited to silk flowers, dried flowers, feathers, ivy, fur, fake fur, rocks, glass stones, stones, shells, starfish, dry beans, dry pasta, candy canes, airless balloons, twigs, leaves, branches, acorns, rice, Styrofoam, crayons, pencils, cotton balls, fake snow, pine cones, glitter, tissue paper, felt, beads, lace, candy canes, hard candy, ornaments, garland, wire, raffia, twigs, wax, dog biscuits, holly, berries, dried fruit, rope, thread, fibers, yarn, paperclips, staples, pens, pencils, markers, brushes and the like can be applied to the window frame 20. It should readily be understood, however, that the types of material that can be used are virtually endless, and anything that is used for the three dimensional effects 32 can also be used for the border (described supra).

In the present embodiment, three-dimensional effects 32 are selected to accent the various pictures 14. For example, dark purple leaves may be appropriate to enhance a Japanese Maple Tree in a photo. Likewise, a yellow sunflower may be used to enhance a hair clip. Still further, small yellow fuzzy flowers may be used to enhance a bouquet of flowers in a picture. As with the border, the three-dimensional effects 32 can be any variety of materials. In the present embodiment, the three-dimensional effects 32 are chosen based on the nature of the pictures 14 and the environment and elements involved chosen.

While the previous embodiments of the present invention envisions picture(s) 14 that will be permanently fixed, it is also possible to adapt the above described invention to allow for one or more pictures 14 to be removed and replaced. Several ways to adapt the present invention for this alternative embodiment would be to affix the picture(s) 14 to the rear of the window 12. The backing 16 could then be adhered as described above, or the backing 16 could be adhered on three or fewer sides so that access to the picture(s) 14 can be accomplished in an easier fashion. Another alternative embodiment would be to leave the pictures 14 placed on the front side of the window 12, but adhere the custom cut glass 28 using a re-usable and/or re-sealable adhesive material, such as VELCRO or putty or paste that is commonly used to hang pictures or posters on walls, in one or more of the corner(s) of the glass 28. Obviously, there is no special requirement that the self adhesive material be placed in the corner(s), but can also be placed along one or more of the sides of the glass 28. In order to conceal the adhesive material, border filler could then be placed on top of the glass 28 in the areas where application of the self adhesive materials was made. Still another alternative embodiment would be to leave the pictures 14 placed on the front side of the window 12, but to adhere the custom cut glass 28 on fewer than all four sides. In this last embodiment the adhesive used could be one that is either permanent or one that is re-usable and/or re-sealable.

Although the present invention above is described in terms of using a glass window 12 and certain embodiments include the use of what is referred to as custom cut glass 28, it should be easily understood by those skilled in the art that glass is not absolutely required. Any relatively clear, non-opaque substance will suffice. One such common substance which will certainly work and which is a part of the present invention is plastic.

While the present invention has been described above in terms of specific embodiments, it is to be understood that the invention is not limited to these disclosed embodiments. Variations are possible within the teachings of the present invention. The scope of the invention should be determined by proper interpretation and construction of the appended claims and their legal equivalents.

The invention claimed is:

1. A custom framing apparatus comprising:

a. a window frame having a front and a back, and said window frame having a windowpane affixed thereto;

b. a picture affixed to the windowpane;

c. an adhesive material; and d. a piece of glass being attached to the windowpane through the application of the adhesive material to the piece of glass;

wherein the picture is affixed to the windowpane by an additional adhesive material.

2. The custom framing apparatus of claim 1, wherein said picture is situated between said piece of glass and said windowpane.

3. The custom framing apparatus of claim 1, further comprising a plurality of three-dimensional effects affixed to said window frame.

4. The custom framing apparatus of claim 1, wherein said window frame is painted.

5. The custom framing apparatus of claim 1, further comprising a decorative pattern applied to said window frame.

6. The custom framing apparatus of claim 1, wherein said window frame has been previously used as a window.

7. The custom framing apparatus of claim 1, wherein said piece of glass is custom cut to fit said window frame.

8. The custom framing apparatus of claim 1, further comprising a backing and a hanger affixed to the back of said window frame.

9. A custom framing apparatus comprising:

a window frame having a front and a back, and said window frame having a windowpane affixed thereto;

a picture affixed to the windowpane;

an adhesive material;

a piece of glass being attached to the windowpane through the application of the adhesive material to the piece of glass;

wherein the picture is affixed to the windowpane by an additional adhesive material;

a plurality of windowpanes affixed to said window frame;

a plurality of pieces of glass, wherein each of said pieces of glass is attached to one of said windowpanes; and a plurality of pictures, wherein each of said pictures is situated between one of said pieces of glass and windowpanes.

10. The custom framing apparatus of claim 9, wherein said pictures comprise an anthology with a particular motif.

11. The custom framing apparatus of claim 10, further comprising a decorative effect applied to said window frame, wherein said decorative effect reflects the motif of said anthology of pictures.

12. The custom framing apparatus of claim 11, wherein the decorative effect comprises a pattern applied to said window frame.

13. The custom framing apparatus of claim 11, wherein the decorative effect comprises a plurality of three-dimensional objects affixed to said window frame.

14. A method of making a custom framing apparatus comprising the steps of:

a. obtaining a window frame having a windowpane affixed thereto;

b. obtaining at least one picture;

c. applying an adhesive material to the back of the picture;

d. applying the picture to the windowpane; and e. affixing a pane of relatively clear material to the windowpane with an adhesive material.

15. The method of making a custom framing apparatus according to claim 14, further comprising the step of applying a decorative pattern to the window frame.

16. The method of making a custom framing apparatus according to claim 14, further comprising the step of painting the window frame.

17. The method of making a custom framing apparatus according to claim 14, further comprising the step of affixing three-dimensional items to the window frame.

18. The method of making a custom framing apparatus according to claim 14, wherein the window frame comprises a previously used window frame.

19. The method of making a custom framing apparatus according to claim 18, further comprising the step of repairing defects in the previously used window frame.

20. The method of making a custom framing apparatus according to claim 14, further comprising the step of treating the window frame to appear weathered.

* * * * *